US006236303B1

(12) United States Patent
Wagner et al.

(10) Patent No.: US 6,236,303 B1
(45) Date of Patent: May 22, 2001

(54) SYSTEM FOR INDICATING THE STATUS OF A HOTEL OR SIMILAR ROOM

(76) Inventors: Joerg Cornelius Wagner, 12 - 450 Yates Road, Kelowna, British Columbia (CA), V1V 1R8; Joseph Karl Hans Huber, #-5 4524 Eldorado Court, Kelowna, British Columbia (CA), V1W 1G3

( * ) Notice: Subject to any disclaimer, the term of this patent is extended or adjusted under 35 U.S.C. 154(b) by 0 days.

(21) Appl. No.: 09/330,979

(22) Filed: Jun. 14, 1999

(51) Int. Cl.[7] ..... G08B 5/00
(52) U.S. Cl. ..... 340/286.08; 340/332
(58) Field of Search ..... 340/286.08, 541, 340/540, 815.47, 815.45, 300, 330, 332

(56) References Cited

U.S. PATENT DOCUMENTS

| | | | | |
|---|---|---|---|---|
| 3,588,868 | * | 6/1971 | Head | 340/286.08 |
| 3,631,449 | * | 12/1971 | Head | 340/293 |
| 3,668,682 | * | 6/1972 | Barbee et al. | 340/286 R |
| 3,705,422 | | 12/1972 | Savey | 340/286.08 |
| 3,797,009 | | 3/1974 | Crudgington, Jr. | 340/286.08 |
| 3,964,058 | * | 6/1976 | Winston | 340/330 |
| 4,194,181 | * | 3/1980 | Brundage | 340/286 R |
| 4,237,344 | * | 12/1980 | Moore | 340/286 R |
| 5,283,549 | * | 2/1994 | Mehaffey et al. | 340/521 |
| 5,309,146 | * | 5/1994 | Kenet | 340/540 |
| 5,476,221 | * | 12/1995 | Seymour | 236/47 |
| 5,850,753 | | 12/1998 | Varma | 70/278.7 |
| 5,861,806 | | 1/1999 | Vories et al. | 340/545.3 |

* cited by examiner

*Primary Examiner*—Daniel J. Wu
*Assistant Examiner*—Sihong Huang
(74) *Attorney, Agent, or Firm*—Oyen Wiggs Green & Mutala

(57) ABSTRACT

A system is described which replaces conventional "do not disturb" and "maid service" or "housekeeping" signs in hotel guestrooms. The system comprises means for allowing a hotel guest to choose, from within the hotel room, a message to convey to hotel staff and others such as "do not disturb". The message is expressed by indicators housed within assemblies located outside of the hotel room, which are visible to passers-by. The system may also convey such messages to a more remote location such as a housekeeping office and the switch may be activated remotely.

19 Claims, 4 Drawing Sheets

SYSTEM FOR INDICATING THE STATUS OF A HOTEL OR SIMILAR ROOM

Technical Field

The invention described herein relates to systems for indicating the status of a hotel room, hotel suite, hotel apartment or the like, such as for indicating certain requirements of a hotel guest to hotel staff and others, and more particularly to a system which replaces the conventional "do not disturb" and "maid service" or "housekeeping" signs in hotel guestrooms.

BACKGROUND

People who stay in hotels and motels are familiar with what are commonly known as "do not disturb" signs. Such signs are typically small rectangular paper or plastic signs which may be hung on the outside handle or doorknob of the door of a hotel guestroom to indicate that the guest staying in that room desires privacy. Typically, one face of such a sign will bear the words "do not disturb", or something to that effect, and may bear a symbol representing this sentiment.

Also familiar to hotel guests are similar signs which might be called "maid service" or "housekeeping" signs, which, when placed on the outer side of the hotel room door, indicate to the housekeeping staff of the hotel that the guest desires the room to be "made up" (the bed linens changed, the bathroom tidied, towels replaced, etc.). Such a sign is often hung out by the guest upon leaving the room for an extended period of time so that the room might be made up before he or she returns to the room.

In most hotels, a combination sign is used, one side of the sign showing "do not disturb", and the other indicating "housekeeping" or "maid service".

While such signs have been used in hotels for decades, they have certain disadvantages which the invention described herein overcomes. One such disadvantage is that such signs may be lost or misplaced, so that a guest may not be able to hang it outside of the door when desired. Such signs also become damaged and so require periodic replacement at considerable expense. Such signs also require that the hotel door be opened to hang the sign outside, where it is visible. It may in fact be inconvenient for the guest, or otherwise undesired by the guest, to open the hotel room door to hang the sign outside, especially when the guest is seeking privacy. It may in some instances be dangerous to do so. If the hotel guest has decided not to place the sign outside the door due to inconvenience or danger, there is a risk that the guest will be disturbed by an unwanted intrusion.

A further disadvantage of the current "do not disturb" signs is that they are subject to being interfered with by vandals or jokesters. A sign displaying "do not disturb" can be changed to "maid service please", or completely removed, by a stranger as a joke or act of vandalism, without the knowledge of the occupant of the room, with the result that again the hotel guest will likely be disturbed by an unwanted intrusion.

Another disadvantage of such signs, which is overcome by one embodiment of the current invention, is that they can be read only from a location quite close to the room in question. A maid cannot tell from a distance which rooms are available to be made up, and must walk to the vicinity of each room. The current signs cannot indicate directly to the central housekeeping office, for example, that a room is ready to be "made-up"; a housekeeper must discover this for his or herself by walking past the room and noticing the sign.

While reference is made herein to hotel rooms and hotel guests as the occupants of such rooms, it will be apparent that while the invention is particularly suited to hotels and motels, it has application to any private room for temporary or permanent lodging which requires periodic servicing, such as hotel rooms, motel rooms, hotel apartments, private rooms in hospitals or rest homes, and apartments in senior citizen homes. Where a reference is made herein to a hotel guest or occupant therefore, it is intended that such reference also applies to any temporary or permanent occupant of any such rooms, including a staff member of the hotel who may wish to leave an indication of the status of the room.

SUMMARY OF INVENTION

The present invention provides a system for indicating the status of a hotel room to hotel staff and others and comprises selecting means allowing a hotel guest to select a message to be conveyed to a recipient, the selecting means being accessible to the hotel guest within the interior of a hotel room. The system also comprises indicating means connected to the selecting means for indicating the message selected by the hotel guest to the recipient, the indicating means accessible to the recipient outside of the hotel room.

The selecting means may comprise a switch assembly mounted within the hotel room, the switch assembly typically comprising a switch switchable between a plurality of switch positions, each one of these switch positions representative of a guest's selection of a particular predetermined message desired to be conveyed to the recipient. The switch assembly may be mounted to an interior wall of the hotel room, or may be located instead or in addition at one or more locations in the interior of the room, such as at a bedside console, in the bathroom etc.

The indicating means may comprise an indicating assembly mounted outside of the hotel room, with the indicating assembly comprising a plurality of message indicators, each one of the message indicators corresponding to a particular one of the switch positions of the switch so that when a switch position is selected by a hotel guest, a corresponding message indicator indicates the predetermined message intended to be conveyed by the guest to a recipient. The indicating assembly is mounted to the exterior wall of the hotel room, and may be mounted near the door of the hotel room.

The switch assembly and said indicating assembly may be electrically connected, and the system may be powered by batteries or wired into the hotel's electrical system.

In one embodiment of the invention, the switch is switchable between a first "off" position, a first "on" position representing a guest's desire not to be disturbed, and a second "on" position representing a guest's desire to have hotel housekeeping staff make up the hotel room. Textual or symbolic representation of the message associated with each of these switch positions may be added to the switch assembly to allow a guest to easily choose between them. The "do not disturb" message may be indicated by a red light, and the "housekeeping" message may be indicated by a green light on the outside of the room. Corresponding indicator lights may light inside of the room to provide feedback to the room occupant. Additional messages, such as "ready for occupancy", or "emergency help needed", can also be included.

The system may also convey messages remotely and may receive remote instructions, to allow communications between the system and a remote hotel staff office.

BRIEF DESCRIPTION OF DRAWINGS

In drawings which illustrate a preferred embodiment of the invention:

FIG. 5 is a schematic circuit diagram illustrating a battery-powered embodiment of the invention with security alarm feature.

DESCRIPTION

Generally, the invention described herein allows a hotel guest to indicate various messages to hotel staff and others without leaving the guest's hotel room or opening the hotel room door to hang a typical "do not disturb" sign on the doorknob of the hotel room door.

The invention is embodied in the system described hereafter and shown in the accompanying figures, although it will be appreciated by those skilled in the art that many alterations and modifications of the system described hereafter are possible in the practice of this invention without departing from its spirit and scope.

Figure 1:
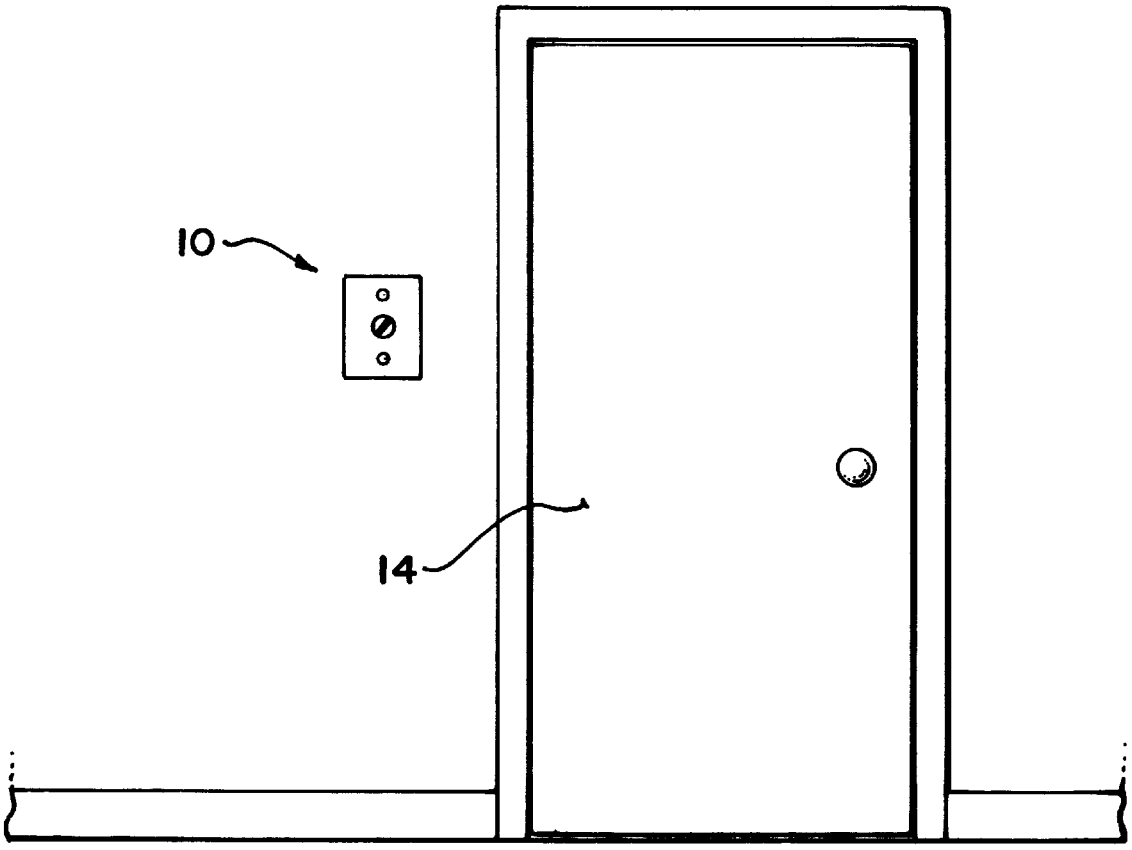
FIG. 1 is an elevation view of a portion of the inside of a hotel room, showing the switch assembly of a system embodying the invention mounted on the hotel room wall near the hotel room door.
Figure 2:
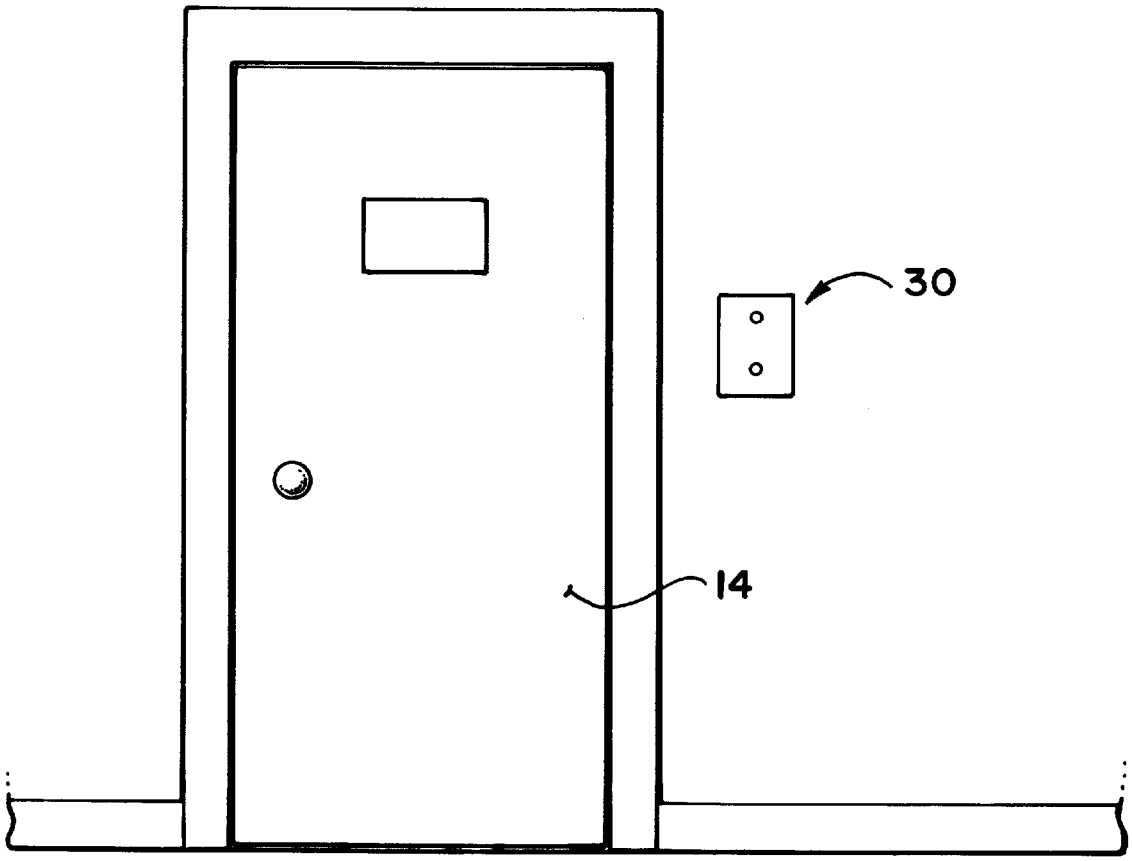
FIG. 2 is an elevation view of a portion of the outside of the hotel room shown in FIG. 1, seen from the hotel hallway, showing the indicating assembly of the inventive system mounted on the wall near the hotel room door.

Referring to FIGS. 1 and 2, a preferred embodiment of the inventive system comprises a switch assembly, generally denoted 10 herein, and an indicating assembly, 30.

In this preferred embodiment of the invention, switch assembly 10 comprises a switch 12 (FIG. 3) which may be housed within a housing (not shown in its entirety) which may be mounted somewhere in the interior of a hotel room. The switch housing may include a mounting plate 16 which allows assembly 10 to be mounted on a wall in the hotel room, preferably near the door 14 of the hotel room, or, also conveniently, near the hotel bed or telephone. The switch assembly may be located instead or in addition at one or more locations in the interior of the room, such as at a bedside console, in the bathroom etc., whether associated with a mounting plate or mounted in some other way such as part of a larger console or plate. Mounting plate 16 may of course be any suitable dimension or shape or colour and may be mounted by any suitable means, including by screws 18 or similar fasteners, or adhesives. Alternatively mounting plate 16 could form part of a larger cover plate accommodating lighting switches, air conditioning, television controls etc.

Figure 3:
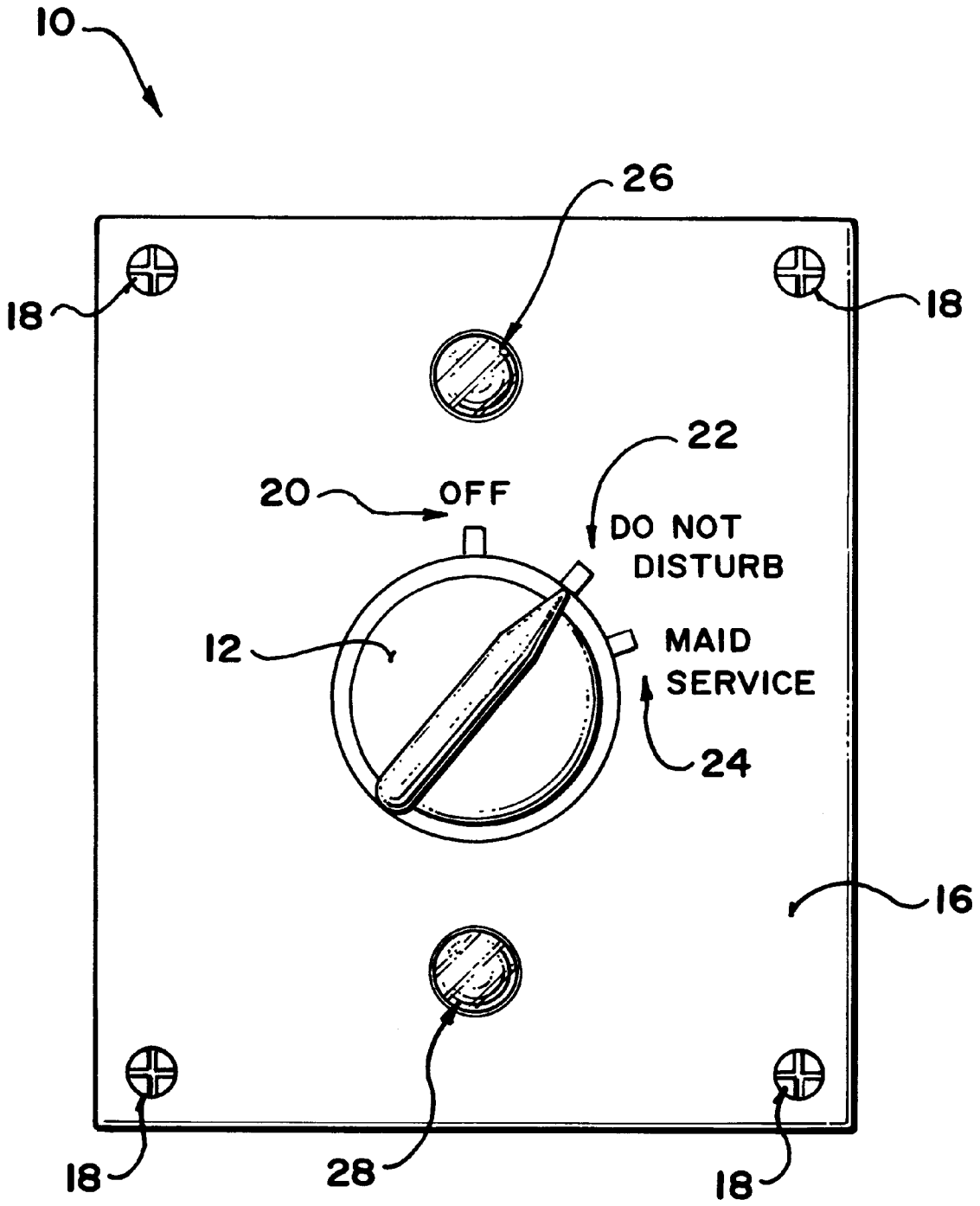
FIG. 3 is a front view of the switch assembly of the system shown in FIG. 1.
Figure 4:
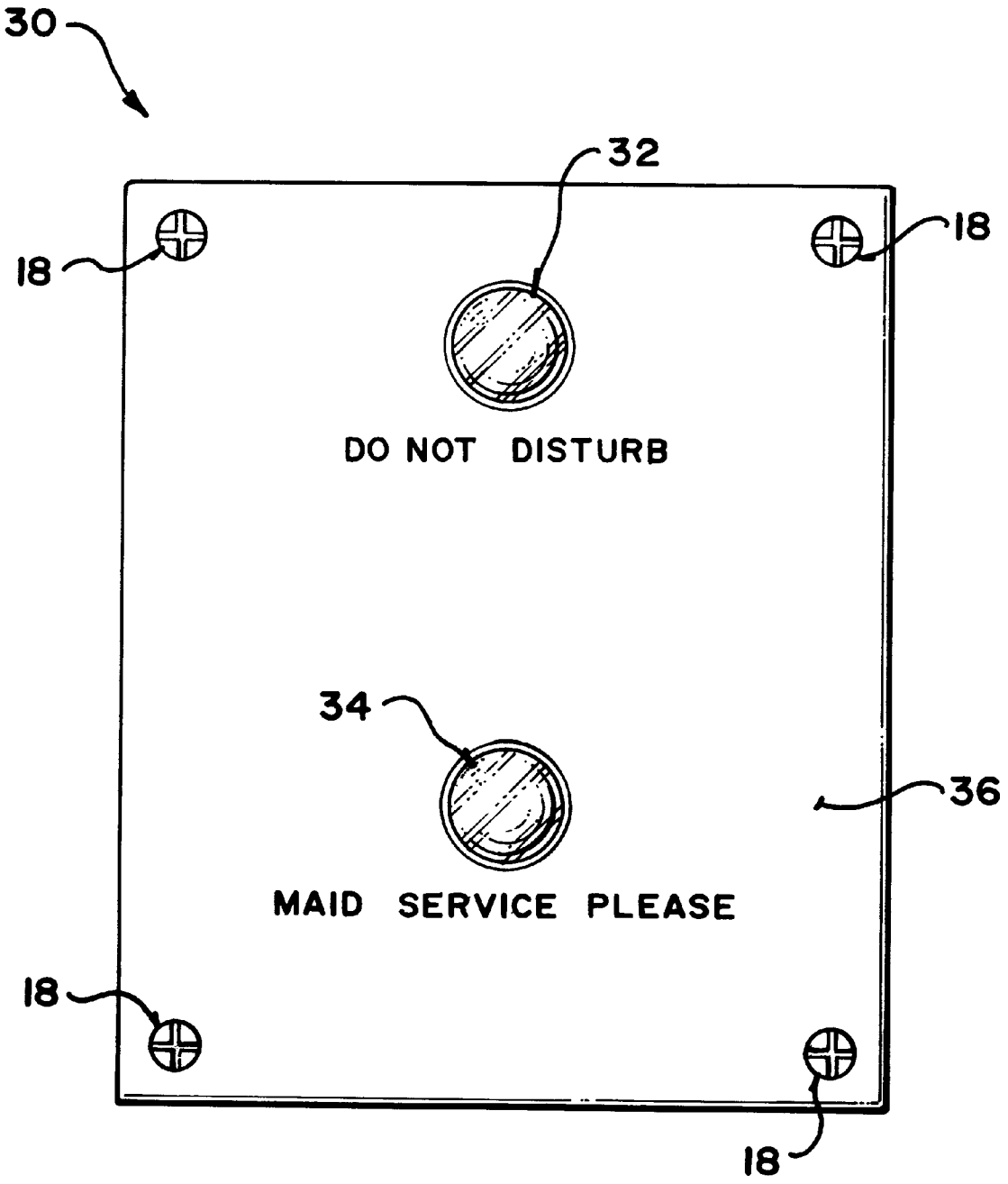
FIG. 4 is a front view of the indicating assembly of the system shown in FIG. 2.

Switch 12 may be any type of switch switchable between a plurality of positions. A rotary switch is effectively employed in this described embodiment. The switch may have an "off" position 20 in addition to other positions, which in this embodiment are "on" positions representing "do not disturb" 22 and "maid service" 24. Appropriate textual markings (as shown in FIG. 3) showing these switch positions, thereby allowing a hotel guest to easily choose between them, may be associated with switch 12 or mounting plate 16. Similar symbolic markings may also be added or may take the place of such text. In operation, when a guest chooses to indicate either "do not disturb" or "maid service", the guest switches switch 12 to the appropriate position 22 or 24 from the "off" position 20. Additional messages, such as "ready for occupancy", or "emergency help needed", can also be included at additional switch positions. A system in which there is a single "do not disturb" "on" position would also be useful.

Indicating assembly 30 is connected to switch assembly 10, preferably electrically, and mounted outside of the hotel room, conveniently on the wall surface outside of the hotel room, near the hotel room door. Indicating assembly 30 comprises indicators which may be contained within a mountable housing and which may also comprise a mounting plate 36 useful for mounting indicating assembly 30 to a wall. Mounting plate 36 may generally be of similar size and shape to mounting plate 16.

While it is possible for this system to be battery powered by battery 50, it is convenient and useful for the system to be wired directly into the hotel's electrical system, for reasons to be discussed further below.

In a preferred embodiment, the indicators comprise a plurality of lights mounted in mounting plate 36, and indicating assembly 30 is electrically connected to switching assembly 10 in a way known in the art such that when switch 12 is switched to a first "on" position, one of the indicator lights turns on, indicating a certain status of the room. The switching of switch 12 to another "on" position turns on another indicator light. In the embodiment discussed herein, indicating assembly 30 has two lights, a red light 32 which is illuminated when switch 12 is switched to the "do not disturb" position, and a green light 34 which is illuminated when switch 12 is switched to the "maid service" position. These lights preferably have a refractive or luminescent dome so that the lights are visible from a considerable distance and a broad viewing angle. This facilitates the ability of the maid to assess which rooms are ready for cleaning by looking down the hotel corridor and without approaching each room individually. By using internationally understood colours such as red and green, the meaning of the different lights is rapidly learned even by non-English-speaking staff or guests. For additional messages, such as "ready for occupancy", or "emergency help needed", different colours, such as yellow or orange, or flashing of the lights could be used. For example, switching to "ready for occupancy" could cause green light 34 to flash, and switching to "emergency help needed" could cause red light 32 to flash.

To allow a guest to tell the state of the system at a glance, and in the dark, switch assembly 10 may itself house indicator lights 26, 28 corresponding to lights 32, 34 housed in indicator housing 30 which are illuminated concurrently with lights 32 or 34 respectively. This allows the guest to confirm, for example, that the "do not disturb" light is on outside of the hotel room, without having to check the position of switch 12.

It will therefore be appreciated that the guest's intentions and desires in respect of these requirements are accordingly conveyed to hotel staff and other passers-by in a similar manner as they are expressed by the hanging of conventional "do not disturb" signs from the hotel door doorknob, but much more efficiently, and without the need to open the door and are as well visible at a distance. Similarly a staff member can indicate to others that a particular room is clean and ready for occupancy.

While no particular indication is required to hotel staff or others when switch 12 is in the "off" position, an indicator light indicating this state may also be provided if desired. What will also be appreciated is that other messages apart from "do not disturb" and "maid service" may be conveyed in a similar manner, with switches that allow guests to choose from further options, including, for example, a "trouble" message which a guest may wish to convey when the guest is in urgent need of assistance.

In a further embodiment, switch 12 is wired not only to send electrical signals to indicating assembly 30, but also to a remote location. Such a message may be conveyed to housekeeping staff, for example, which may be located in a housekeeping office or staffroom. This way, guest-rooms may be more closely monitored for "maid service" messages, for example, and it is not required that the intended recipient of the message pass by the guest room from which the message is sent to notice it.

Similarly, if the system is connected to the housekeeping office or front desk, switch 12 can be fashioned to be remotely actuated, so that, for example, a "housekeeping" indicator light can be turned on outside the hotel room by a housekeeping manager, or a front desk clerk when he or she checks a guest out of the hotel, indicating to housekeeping staff that the room may be made up.

In order to control features of the invention, a microprocessor 52 may be provided, for example to control electronic push button/membrane switches, operation of a plurality of lights, including blinking lights, remote switching and actuation, and the security/alarm feature described as follows. The invention may provide a security/alarm feature to alert a room occupant or hotel staff that an unauthorized intruder has entered the room. The security/alarm feature may be set either automatically whenever the "do not disturb" is on, or, could be separately activated. Activation is via electronic/membrane keypad 54 inside the hotel room. The function is microprocessor controlled. The alarm switch input will come either from an existing alarm sensor 56 (if any), or from a newly installed door proximity switch or from a motion sensor. Activation of the security feature causes the alarm sensor to be activated by timing means 58 after a pre-set delay to permit the occupant to leave the room. When the door switch or the motion sensor is activated, the microprocessor will set the outside "do not disturb" light to blink, or will display a different discreet message either via a separate light or via LCD panel. The alarm is reset/deactivated inside the room by entering of a password, which each guest would be assigned. The hotel staff is provided a separate password. Once the security feature is activated, triggering of the proximity switch or motion sensor will result in the sending of an alarm signal by means for signalling an alarm condition 60 on microprocessor 52 unless the system is deactivated by timing means 58 with in a preset delay which permits the occupant to de-activate the system upon returning to the room. The alarm signal is sent to the central monitoring station where the alarm is monitored by hotel security staff, and also may provide a signal on the exterior of the room to alert the occupant of an unauthorized entry. The system may store the relevant data for the last number of entries in order to be able to track the usage.

As a further aspect of the invention, the switching of the unit to "do not disturb" for example, could activate a time-delayed motion sensor connected to the door to sense whether the room has been entered after the guest has departed, and activate a flashing light, for example, on the exterior indicator 30 if it has, so that the guest, on returning to the room, is alerted to the fact that an intruder has entered the room.

As noted earlier, while the foregoing describes one embodiment of the present invention, the invention may be embodied in similar systems, and it will be apparent to those skilled in the art in the light of the foregoing disclosure that many alterations and modifications are possible in the practice of this invention without departing from it.

For example, it should be clear to those who understand the foregoing that the inventor of this invention appreciates that a wide variety of devices could be used as indicators in addition to or in place of lights. For example, audio signals or an LCD display could be used to indicate different messages desired to be conveyed by the guest or by the hotel staff. It should also be clear that various types of lights could be used, and that it is not necessary to employ a plurality of lights to indicate different states. A single light could be employed if it were capable of indicating different colours, for example, and different states of flashing and brightness, for example.

Similarly, the inventor believes that it should be clear to those skilled in the art that a wide variety of switches may usefully be employed in the practice of the invention. Mechanical switches, for example, are not necessarily required, as electronic push-button switches would also be effective. As another example, it is not required that respective assemblies of the system be mounted to walls. Such assemblies could, for example, be mounted in hotel room doors themselves, on furniture, chairs or freestanding remote control units.

Accordingly, the scope of the invention is to be construed in accordance with the substance defined by the following claims.

What is claimed is:

1. In a multiple-room building, where a plurality of rooms are each connected by a doorway to a common corridor, a system for indicating the status of one of said rooms comprising selecting means allowing an occupant of said one of said rooms to select a message to be conveyed to a recipient in said common corridor, said selecting means accessible to the occupant within the interior of said one of said rooms, and indicating means electrically connected to said selecting means for indicating the message selected by the occupant to the recipient when said message is selected, said indicating means viewable by the recipient from said common corridor; wherein said selecting means comprises a switch assembly mounted within said one of said rooms, said switch assembly comprising a switch switchable between an "off" position and a plurality of "on" positions, each one of said switch "on" positions representing said occupant's selection of a particular pre-determined message, said switch assembly comprising means for indicating to said occupant the massage associated with each "on" position; and wherein said indicating means comprises an indicating assembly mounted in said common corridor, said indicating assembly comprising a plurality of message indicators, each one of said message indicators corresponding to a particular one of said switch "on" positions such that when a switch "on" position is selected by said occupant, a corresponding message indicator indicates the predetermined message intended to be conveyed by the occupant to a recipient.

2. A system as claimed in claim 1 wherein said switch assembly is mounted to an interior wall of said room.

3. A system as claimed in claim 1 wherein said indicating assembly is mounted to a wall of said corridor adjacent the doorway of said one of said rooms.

4. A system as claimed in claim 1 wherein said switch is switchable between a first "off" position, a first "on" position representing the message that the occupant does not wish to be disturbed, and a second "on" position representing the message that the occupant wishes to have the said one of said rooms cleaned or made up.

5. A system as claimed in claim 4 wherein said switch is switchable to a position indicating that the guest requires immediate assistance.

6. A system as claimed in claim 4 wherein said switch is switchable to a position indicating that the room is available for occupancy.

7. A system as claimed in claim 1 wherein said switch assembly means for indicating to said occupant the message associated with each "on" position comprises a textual or symbolic representation of the message associated with each of said switch positions.

8. A system as claimed in claim 1 wherein one of said message indicators comprises a red light in association with one of said "on" positions and wherein another of said message indicators comprises a green light in association with another of said "on" positions.

9. A system as claimed in claim 8 wherein said indicating assembly further comprises a textual or symbolic representation of the message associated with each of said message indicators.

10. A system as claimed in claim 8 wherein said system is powered by batteries.

11. A system as claimed in claim 8 wherein said system is wired into the electrical system of a hotel.

12. A system as claimed in claim 1 wherein said multiple-room building comprises a hotel or motel and said occupant is a hotel or motel guest.

13. A system as claimed in claim 1 wherein said indicating means may be actuated remotely.

14. A system as claimed in claim 1 further comprising a microprocessor.

15. A system as claimed in claim 14 further comprising a security/alarm feature comprising:

a) means for detecting unauthorized entry of a person into said room;

b) means for activating and de-activating a security/alarm feature;

c) timing means; and d) means for signalling an alarm condition when said feature is activated, an unauthorized entry into said room has been detected and said feature is not deactivated within a preset period of delay.

16. A system as claimed in claim 15 wherein said means for de-activating comprises a password-controlled deactivation means.

17. A system as claimed in claim 15 wherein said means for signalling an alarm condition comprises means for communicating said alarm condition to a remote location.

18. A system as claimed in claim 1 wherein the message selected by said selection means is also conveyed to a location remote from said selection means and remote from said indicating means.

19. A system as claimed in claim 18 wherein said indicating means may also be actuated remotely.

* * * * *